US008739982B2

(12) United States Patent
Werner

(10) Patent No.: US 8,739,982 B2
(45) Date of Patent: Jun. 3, 2014

(54) SHELF-MOUNTED HANDGUN RACK

(71) Applicant: Theodore J. Werner, Huntington Station, NY (US)

(72) Inventor: Theodore J. Werner, Huntington Station, NY (US)

( * ) Notice: Subject to any disclaimer, the term of this patent is extended or adjusted under 35 U.S.C. 154(b) by 0 days.

(21) Appl. No.: 13/652,633

(22) Filed: Oct. 16, 2012

(65) Prior Publication Data

US 2014/0102999 A1 Apr. 17, 2014

(51) Int. Cl.

| | |
|---|---|
| ***A47F 7/00*** | (2006.01) |
| *A47F 5/00* | (2006.01) |
| *A47G 29/087* | (2006.01) |
| *B65D 85/00* | (2006.01) |
| *F41C 27/00* | (2006.01) |
| *A47B 96/06* | (2006.01) |

(52) U.S. Cl.
USPC ..... 211/64; 211/86.01; 211/119.003; 206/317; 42/94; 248/220.31

(58) Field of Classification Search
USPC ..... 211/64, 86.01, 119.003, 119.005, 183; 312/245, 235.8, 237; 108/29–31, 108/50.11; 206/317, 493; 248/231.31, 248/220.21, 220.41, 220.42, 220.43, 913; 42/94
See application file for complete search history.

(56) References Cited

U.S. PATENT DOCUMENTS

| | | | | | |
|---|---|---|---|---|---|
| 945,520 | A | * | 1/1910 | Greenwood | 248/175 |
| 1,072,248 | A | * | 9/1913 | McNaughton | 248/295.11 |
| 1,108,692 | A | * | 8/1914 | Burd | 108/97 |
| 1,164,966 | A | * | 12/1915 | Sturgis | 312/232 |
| 1,993,702 | A | * | 3/1935 | Brunhoff | 211/74 |
| 2,327,334 | A | * | 8/1943 | Parker | 42/70.11 |
| 2,626,711 | A | * | 1/1953 | Saul, Jr. et al. | 211/85.8 |
| 2,939,587 | A | | 6/1960 | Kondziolka | |
| 3,211,293 | A | * | 10/1965 | Tarnoff | 248/220.31 |
| 3,252,583 | A | * | 5/1966 | Walther et al. | 211/119 |
| 3,361,265 | A | * | 1/1968 | Wernimont | 211/64 |
| 3,468,427 | A | * | 9/1969 | Leslie | 211/64 |
| 3,545,711 | A | * | 12/1970 | Scheneman | 248/220.43 |
| 3,712,696 | A | * | 1/1973 | McDonnell | 312/245 |
| 3,730,355 | A | * | 5/1973 | Feldman | 211/59.1 |
| 3,779,392 | A | * | 12/1973 | Betts, Sr. | 248/220.43 |
| 3,871,608 | A | * | 3/1975 | Ogden | 248/220.41 |
| 4,373,639 | A | * | 2/1983 | Tricon | 211/119.005 |
| 4,456,125 | A | * | 6/1984 | Chap | 206/513 |
| 4,485,929 | A | * | 12/1984 | Betts, Sr. | 211/74 |
| 4,537,451 | A | * | 8/1985 | Bredderman et al. | 312/6 |
| 4,673,089 | A | * | 6/1987 | Chap | 211/41.2 |
| 5,009,381 | A | * | 4/1991 | Hermanson | 248/220.42 |
| 5,188,328 | A | | 2/1993 | Thompson | |
| 5,313,733 | A | * | 5/1994 | Meade | 42/70.11 |
| 5,481,817 | A | * | 1/1996 | Parker | 248/286.1 |
| 5,503,276 | A | | 4/1996 | Pierce | |
| 5,556,068 | A | * | 9/1996 | Gorelik | 248/220.41 |
| 5,620,104 | A | * | 4/1997 | Maglione | 211/59.1 |

(Continued)

*Primary Examiner* — Joshua J Michener
*Assistant Examiner* — Devin Barnett
(74) *Attorney, Agent, or Firm* — Charles E. Baxley

(57) ABSTRACT

A customizable storage rack replaceably mounted either on a top or on a bottom of a shelf, stores handguns, and positions the handguns at customizable distances from each other. The customizable storage rack includes a body, mandrels, and attaching apparatus. The body is replaceably mounted either on the top or on the bottom of the shelf. The mandrels are replaceably attached to the body, store the handguns, and position the handguns at customizable distances from each other. The attaching apparatus is operatively connected to the body, and replaceably mounts the body either on the top or on the bottom of the shelf.

31 Claims, 7 Drawing Sheets

(56) References Cited

U.S. PATENT DOCUMENTS

| | | | | |
|---|---|---|---|---|
| 5,743,416 | A * | 4/1998 | Yemini | 211/70.6 |
| 5,806,739 | A * | 9/1998 | Wood | 224/555 |
| 5,813,550 | A * | 9/1998 | Sheehan et al. | 211/87.01 |
| 5,913,557 | A | 6/1999 | Jarock | |
| 5,931,316 | A * | 8/1999 | Carpinelli | 211/50 |
| 6,044,773 | A * | 4/2000 | Bauer | 108/50.11 |
| 6,085,916 | A * | 7/2000 | Kovacevic et al. | 211/86.01 |
| 6,085,917 | A * | 7/2000 | Odom | 211/119.003 |
| 6,158,702 | A * | 12/2000 | Kump | 248/206.2 |
| 6,293,414 | B1 * | 9/2001 | Stuart | 211/87.01 |
| 6,401,371 | B2 * | 6/2002 | Martorella | 40/358 |
| 6,431,203 | B1 * | 8/2002 | Zhu et al. | 137/315.01 |
| 6,434,869 | B1 * | 8/2002 | Ngo | 40/607.11 |
| 6,443,316 | B1 * | 9/2002 | Mao | 211/74 |
| 6,726,038 | B2 * | 4/2004 | Ko | 211/153 |
| D494,048 | S * | 8/2004 | Goodman et al. | D8/372 |
| 6,843,081 | B1 * | 1/2005 | Painter | 70/63 |
| 6,997,329 | B2 * | 2/2006 | Ohanian | 211/41.11 |
| 7,055,701 | B2 * | 6/2006 | Dean et al. | 211/26 |
| 7,559,522 | B1 * | 7/2009 | Hlatky | 248/441.1 |
| 7,735,253 | B2 | 6/2010 | Giebel | |
| 8,020,332 | B2 | 9/2011 | Giebel | |
| 8,281,511 | B1 * | 10/2012 | Ligard | 42/70.11 |
| 8,408,666 | B2 * | 4/2013 | Armstrong et al. | 312/408 |
| 8,533,876 | B2 * | 9/2013 | Bonk | 5/503.1 |
| 8,590,714 | B1 * | 11/2013 | Osuna-Valerio | 211/4 |
| 8,596,595 | B2 * | 12/2013 | DeVito | 248/220.31 |
| 2002/0170870 | A1 * | 11/2002 | Callis | 211/119.003 |
| 2003/0029824 | A1 * | 2/2003 | Weiler | 211/184 |
| 2003/0146357 | A1 * | 8/2003 | Bjerke et al. | 248/220.22 |
| 2005/0000141 | A1 * | 1/2005 | Cauley et al. | 42/94 |
| 2007/0251901 | A1 * | 11/2007 | Werner | 211/64 |
| 2009/0001037 | A1 * | 1/2009 | Wilcock | 211/119.003 |
| 2009/0188146 | A1 * | 7/2009 | Werner | 42/94 |
| 2010/0043682 | A1 * | 2/2010 | Talmage et al. | 109/50 |
| 2010/0263253 | A1 * | 10/2010 | Giebel et al. | 42/70.11 |
| 2011/0210654 | A1 * | 9/2011 | Edison Zatz et al. | 312/327 |
| 2012/0222344 | A1 * | 9/2012 | Werner | 42/94 |
| 2012/0255212 | A1 * | 10/2012 | Werner | 42/90 |
| 2012/0261368 | A1 * | 10/2012 | Klein et al. | 211/64 |
| 2013/0199421 | A1 * | 8/2013 | Hjelm | 108/50.11 |
| 2013/0334154 | A1 * | 12/2013 | DeLuca et al. | 211/71.01 |

* cited by examiner

SHELF-MOUNTED HANDGUN RACK

1. BACKGROUND OF THE INVENTION

A. Field of the Invention.

The embodiments of the present invention relate to a handgun rack, and more particularly, the embodiments of the present invention relate to a customizable storage rack for replaceably mounting either on a top or on a bottom of a shelf, for storing handguns, and for positioning the handguns at customizable distances from each other.

B. Description of the Prior Art.

Numerous innovations for handgun racks have been provided in the prior art, which will be described below in chronological order to show advancement in the art, and which are incorporated herein by reference thereto. Even though these innovations may be suitable for the specific individual purposes to which they address, nevertheless, they differ from the embodiments of the present invention in that they do not teach a customizable storage rack for replaceably mounting either on a top or on a bottom of a shelf, for storing handguns, and for positioning the handguns at customizable distances from each other.

(1) U.S. Pat. No. 2,939,587 to Kondziolka

U.S. Pat. No. 2,939,587—issued to Kondziolka on Jun. 7, 1960 in U.S. class 211 and subclass 64—teaches a toy gun rack adapted to be affixed to a wall or the like. The rack includes a support member having apparatus for affixation to the wall, a shelf member attached to the support member and having a plurality of gun barrel cradles that are positioned on the shelf member to be generally horizontal when the support member is affixed to the wall and is open along the side of the shelf member away from the wall, and apparatus attached to one end of the members to bear against an upper portion of gun barrels in the cradles.

(2) U.S. Pat. No. 5,188,328 to Thompson

U.S. Pat. No. 5,188,328—issued to Thompson on Feb. 23, 1993 in U.S. class 248 and subclass 309.2—teaches a bracket for alternate mounting from downwardly facing horizontal surface or a vertical surface, and the bracket rotatably supports a sleeve therefrom in any one of four different elevated positions relative to the bracket, with the sleeve being inclined and supporting a horizontal support rod therefrom of a diameter end length to have the barrel of a revolver telescoped thereover, with the free end of the support rod extending through the revolver barrel and at least substantially the full length of one of the cartridge chambers in the associated revolver cylinder.

(3) U.S. Pat. No. 5,503,276 to Pierce

U.S. Pat. No. 5,503,276—issued to Pierce on Apr. 2, 1996 in U.S. class 211 and subclass 64—teaches a stand for storing multiple handguns, which includes a base and a vertical panel perpendicular to the base. The vertical panel contains a number of slots, with a follower behind the panel and studs extending through the panel to engage a threaded cavity in the follower. The stud and the follower slide in the slot and are locked in place by a stop ring on the stud. The barrel of a handgun slides over the stud and the heel of the grip may rest on the base.

(4) U.S. Pat. No. 5,913,557 to Jarock

U.S. Pat. No. 5,913,557—issued to Jarock on Jun. 22, 1999 in U.S. class 294 and subclass 15—teaches an apparatus for handling a handgun. The handgun includes a barrel with a cylindrical cavity having a selected internal diameter. A handle has a selected length with a grip end and a platform end. The grip end is sized and shaped to be grasped by a human hand. The handle has a handle diameter. A platform has a flat and plate shape with a center point, a periphery, and a platform diameter extending from across the platform through the center point. The platform diameter is greater than the handle diameter. An elongate member extends through the center of the platform and into the handle. The elongate member is selectively engaged to the handle and to the platform. A first rod has a first selected circumference and is rigidly mounted to the platform near the periphery. A second rod has a second selected circumference different from the first selected circumference and is rigidly mounted to the platform near the periphery. The first selected circumference and the second selected circumference are sized so that at least the first rod or the second rod fits relatively snugly within the cavity of the handgun barrel.

(5) U.S. Pat. No. 7,735,253 to Giebel et al

U.S. Pat. No. 7,735,253—issued to Giebel et al. on Jun. 15, 2010 in U.S. class 42 and subclass 70.11—teaches a device for the storage of a gun, which has a base, a safety unit for the secure storage of the gun on the base, and a controller. The safety unit can be inserted at least partially into the barrel and/or a cartridge chamber of the gun and includes a first safety section that can be brought into a safety state in which the safety unit is secured in the gun, and into a release state in which the safety unit can be separated from the gun, and the controller brings the first safety section into its release state when a user authorization is received.

(6) U.S. Pat. No. 8,020,332 to Giebel et al

U.S. Pat. No. 8,020,332—issued to Giebel et al. on Sep. 20, 2011 in U.S. class 42 and subclass 70.11—teaches a device for the storage of a gun, which includes a base, a safety unit for the secure storage of the gun on the base, and a controller. The safety unit can be inserted at least partially into the barrel and/or a cartridge chamber of the gun and includes a first safety section that can be brought into a safety state in which the safety unit is secured in the gun, and into a release state in which the safety unit can be separated from the gun, and the controller brings the first safety section into its release state when a user authorization is received.

It is apparent that numerous innovations for handgun racks have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a customizable storage rack for replaceably mounting either on a top or on a bottom of a shelf, for storing handguns, and for positioning the handguns at customizable distances from each other.

2. SUMMARY OF THE INVENTION

Thus, an object of the embodiments of the present invention is to provide a customizable storage rack for replaceably mounting either on a top or on a bottom of a shelf, for storing handguns, and for positioning the handguns at customizable distances from each other, which avoids the disadvantages of the prior art.

Briefly stated, another object of the embodiments of the present invention is to provide a customizable storage rack replaceably mounted either on a top or on a bottom of a shelf, stores handguns, and positions the handguns at customizable distances from each other. The customizable storage rack includes a body, mandrels, and attaching apparatus. The body is replaceably mounted either on the top or on the bottom of the shelf. The mandrels are replaceably attached to the body, store the handguns, and position the handguns at customizable distances from each other. The attaching apparatus is operatively connected to the body, and replaceably mounts the body either on the top or on the bottom of the shelf.

The novel features considered characteristic of the embodiments of the present invention are set forth in the appended claims. The embodiments of the present invention themselves, however, both as to their construction and to their method of operation together with additional objects and advantages thereof will be best understood from the following description of the embodiments of the present invention when read and understood in connection with the accompanying figures of the drawing.

3. BRIEF DESCRIPTION OF THE FIGURES OF THE DRAWING

The figures of the drawing are briefly described as follows.

Figure 8:
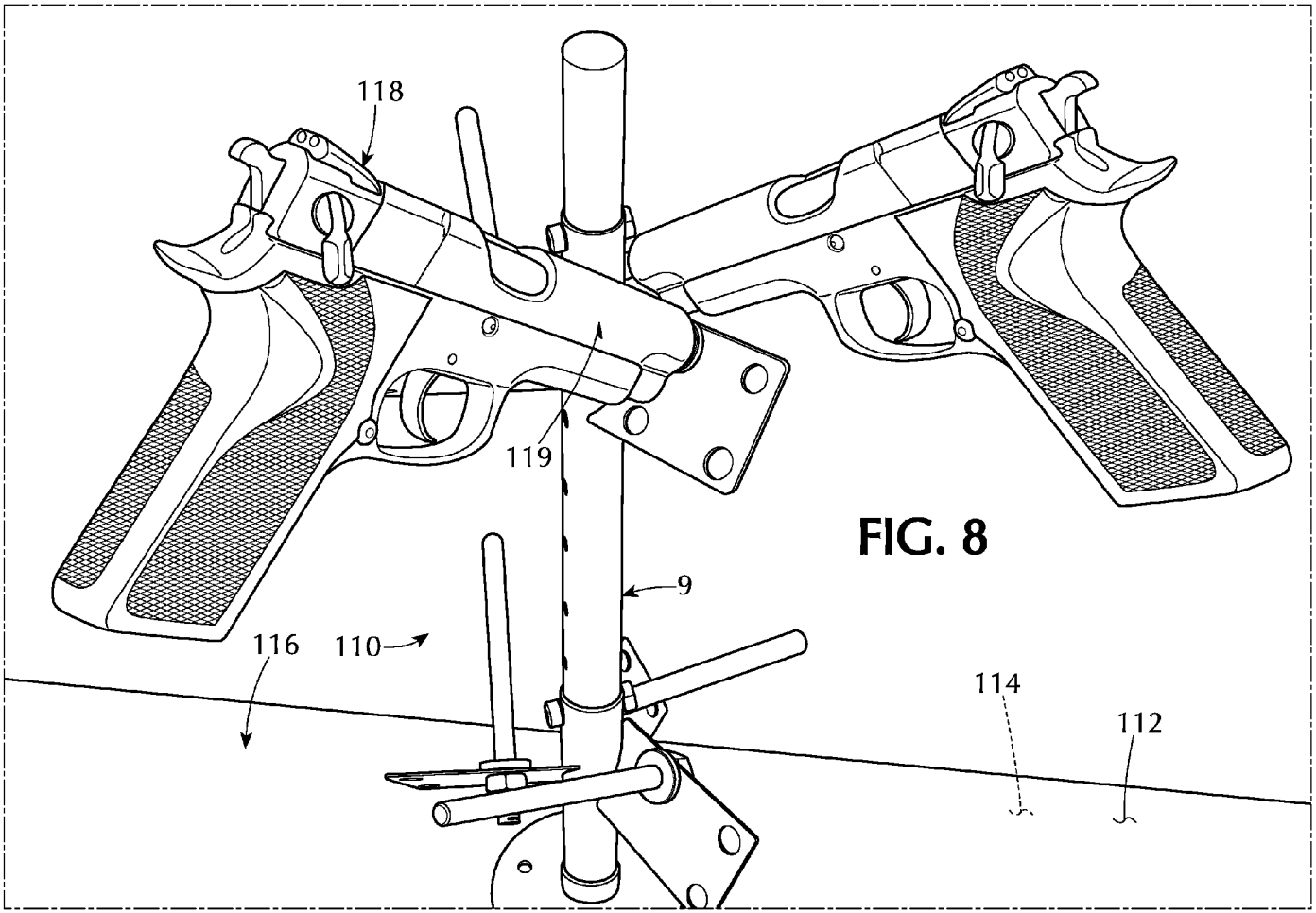
Figure 9:
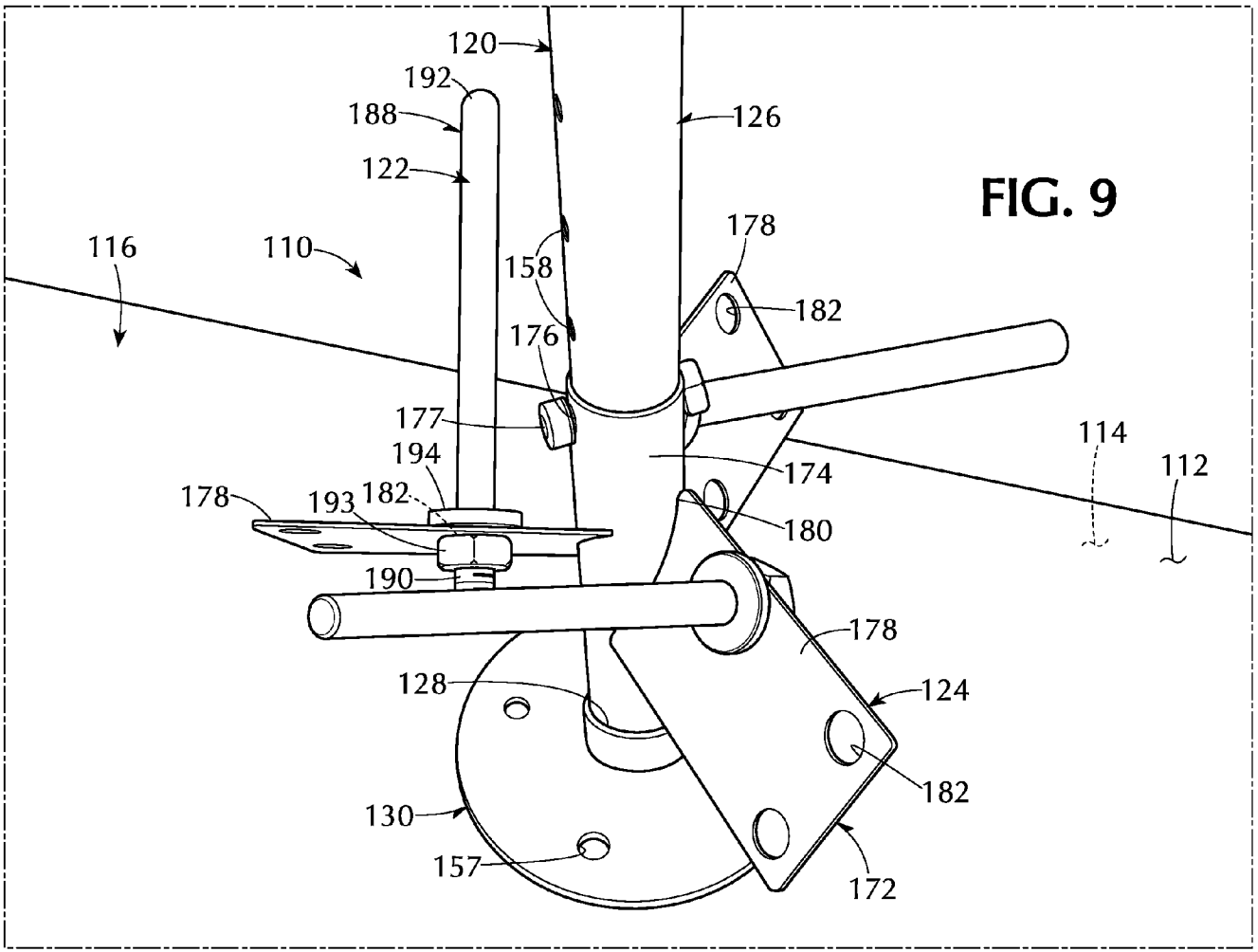

FIG. 8 is a diagrammatic perspective view of a second embodiment of the customizable storage rack of the present invention replaceably mounting either on a top or on a bottom of a shelf, storing handguns, and positioning the handguns at customizable distances from each other; and FIG. 9 is an enlarged diagrammatic perspective view of the second embodiment of the customizable storage rack of the present invention identified by ARROW 9 in FIG. 8.

4. LIST OF REFERENCE NUMERALS UTILIZED IN THE FIGURES OF THE DRAWING

A. First Embodiment Introductory

10 customizable storage rack of first embodiment of present invention for replaceably mounting either on top 12 or on bottom 14 of shelf 16, for storing handguns 18, and for positioning handguns 18 at customizable distances from each other
12 top of shelf 16
14 bottom of shelf 16
16 shelf
18 handguns
19 barrel of each handgun of handguns 18

B. Overall Configuration of First Embodiment of Customizable Storage Rack 10

20 body for replaceably mounting either on top 12 or on bottom 14 of shelf 16
22 mandrels for storing handguns 18, and for positioning handguns 18 at customizable distances from each other
24 attaching apparatus for replaceably mounting body 20 either on top 12 or on bottom 14 of shelf 16

C. Specific Configuration of Body 20

26 front of body 20
28 pair of sides of body 20
30 top of body 20
32 back of body 20
34 lower edge of front 26 of body 20
36 upper edge of front 26 of body 20
38 pair of side edges of front 26 of body 20
40 forward edge of each side of pair of sides 28 of body 20
42 upper edge of each side of pair of sides 28 of body 20
44 rear edge of each side of pair of sides 28 of body 20
46 forward edge of top 30 of body 20
48 rear edge of top 30 of body 20
50 pair of side edges of top 30 of body 20
52 upper edge of back 32 of body 20
54 lower edge of back 32 of body 20
56 pair of side edges of back 32 of body 20
58 open bottom of body 20
60 bottom edge of each side of pair of sides 28 of body 20
62 pair of side extensions of pair of sides 28 of body 20, respectively
64 plurality of through bores of front 26 of body 20
66 parallel rows of through bores of plurality of through bores 64 of front 26 of body
68 plurality of through bores of back 32 of body 20
70 parallel rows of through bores of plurality of through bores 68 of back 32 of body

D. Specific Configuration of Attaching Apparatus 24

72 pair of mounting plates of attaching apparatus 24 for resting on or being attached to either top 12 or bottom 14 of shelf 16
74 pair of junction lines of attaching apparatus 24
76 pair of mounting tubes of attaching apparatus 24
78 pair of J-shaped hooks of attaching apparatus 24 for hooking over shelf 16
80 shank of each J-shaped hook of pair of J-shaped hooks 78 of attaching apparatus 24
82 bend of each J-shaped hook of pair of J-shaped hooks 78 of attaching apparatus 24 for hooking over shelf 16
84 point of each J-shaped hook of pair of J-shaped hooks 78 of attaching apparatus 24 for hooking over shelf 16
86 pair of nuts of attaching apparatus 24

E. Specific Configuration of Mandrels 22

88 peg of each mandrel of mandrels 22

90 proximal end of peg 88 of each mandrel of mandrels 22

92 distal end of peg 88 of each mandrel of mandrels 22 for receiving barrel 19 of associated handgun of handguns 18.

93 nut of peg 88 of each mandrel of mandrels 22

94 stop ring of peg 88 of each mandrel of mandrels 22

F. Second Embodiment Introductory

110 customizable storage rack of second embodiment of present invention for replaceably mounting either on top 112 or on bottom 114 of shelf 116, for storing handguns 118, and for positioning handguns 118 at customizable distances from each other

112 top of shelf 116

114 bottom of shelf 116

116 shelf

118 handguns

119 barrel of each handgun of handguns 118

G. Overall Configuration of Second Embodiment of Customizable Storage Rack 110

120 body for replaceably mounting either on top 112 or on bottom 114 of shelf 116

122 mandrels for being received in barrels 119 of handguns 118 to store handguns 118 and for positioning handguns 118 at customizable distances from each other

124 attaching apparatus

H. Specific Configuration of Body 120

126 tube of body 120

128 bottom of tube 126 of body 120

130 mounting disk of body 120 for replaceably mounting body 120 either on top 112 or on bottom 114 of shelf 116

157 through bores of mounting disk 130 of body 120 for receiving fasteners for replaceably fastening body 120 on either top 112 or on bottom 114 of shelf 116

158 plurality of through bores of tube 126 of body 120

I. Specific Configuration of Attaching Apparatus 124

172 brackets of attaching apparatus 124

174 collar of each bracket of brackets 172 of attaching apparatus 124

176 through bore of collar 174 of each bracket of brackets 172 of attaching apparatus 124

177 fastener of each bracket of brackets 72 of attaching apparatus 124

178 three wings of each bracket of brackets 172 of attaching apparatus 124

180 inner boundary of each wing of three wings 178 of each bracket of brackets 172 of attaching apparatus 124

182 plurality of through bores of each wing of three wings 178 of each bracket of brackets 172 of attaching apparatus 124

J. Specific Configuration of Mandrels 122

188 peg of each mandrel of mandrels 122

190 proximal end of peg 188 of each mandrel of mandrels 122

192 distal end of peg 188 of each mandrel of mandrels 122

193 nut of each mandrel of mandrels 122

194 stop ring of each mandrel of mandrels 122

5. DETAILED DESCRIPTION OF THE PREFERRED EMBODIMENTS

A. First Embodiment Introductory

Figure 1:
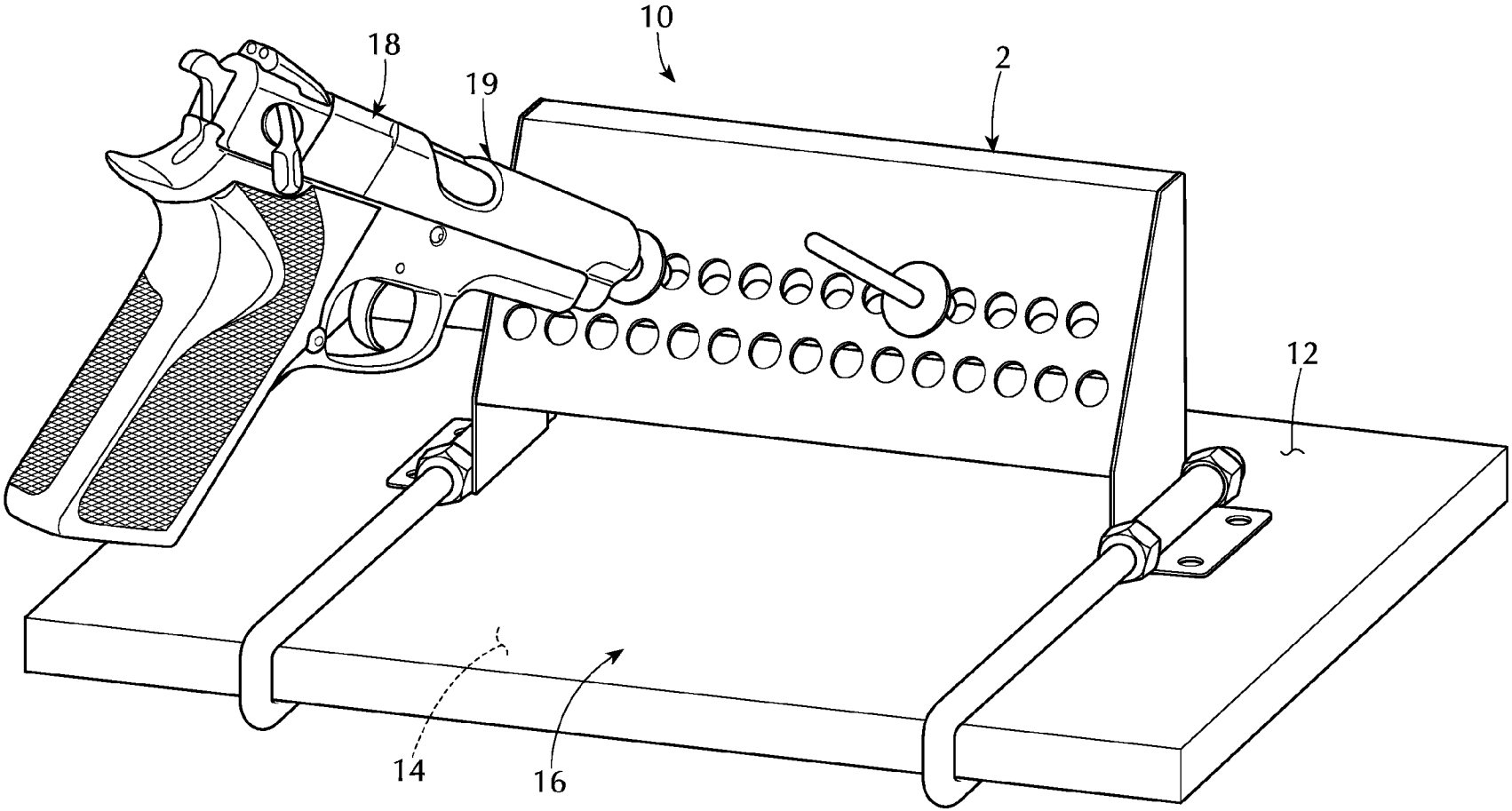
FIG. 1 is a diagrammatic perspective view of a first embodiment of the customizable storage rack of the present invention replaceably mounting either on a top or on a bottom of a shelf, storing handguns, and positioning the handguns at customizable distances from each other.

Referring now to the figures, in which like numerals indicate like parts, and particularly to FIG. 1, which is a diagrammatic perspective view of a first embodiment of the customizable storage rack of the present invention replaceably mounting either on a top or on a bottom of a shelf, storing handguns, and positioning the handguns at customizable distances from each other, the customizable storage rack of the first embodiment of the present invention is shown generally at 10 for replaceably mounting either on a top 12 or on a bottom 14 of a shelf 16, for storing handguns 18, and for positioning the handguns 18 at customizable distances from each other. Each handgun 18 has a barrel 19 with rifling.

B. Overall Configuration of the First Embodiment of the Customizable Storage Rack 10

The overall configuration of the customizable storage rack 10 can best be seen in FIGS. 2 and 3, which are, respectively, an enlarged diagrammatic perspective view of the first embodiment of the customizable storage rack of the present invention identified by ARROW 2 in FIG. 1, and an enlarged diagrammatic end view taken generally in the direction of ARROW 3 in FIG. 2, and as such, will be discussed with reference thereto.

The customizable storage rack 10 comprises a body 20, mandrels 22, and attaching apparatus 24.

The body 20 is for replaceably mounting either on the top 12 or on the bottom 14 of the shelf 16.

The mandrels 22 are replaceably attached to the body 20, are for storing the handguns 18, and are for positioning the handguns 18 at customizable distances from each other.

The attaching apparatus 24 is operatively connected to the body 20, and is for replaceably mounting the body 20 either on the top 12 or on the bottom 14 of the shelf 16.

C. Specific Configuration of the Body 20

Figure 2:
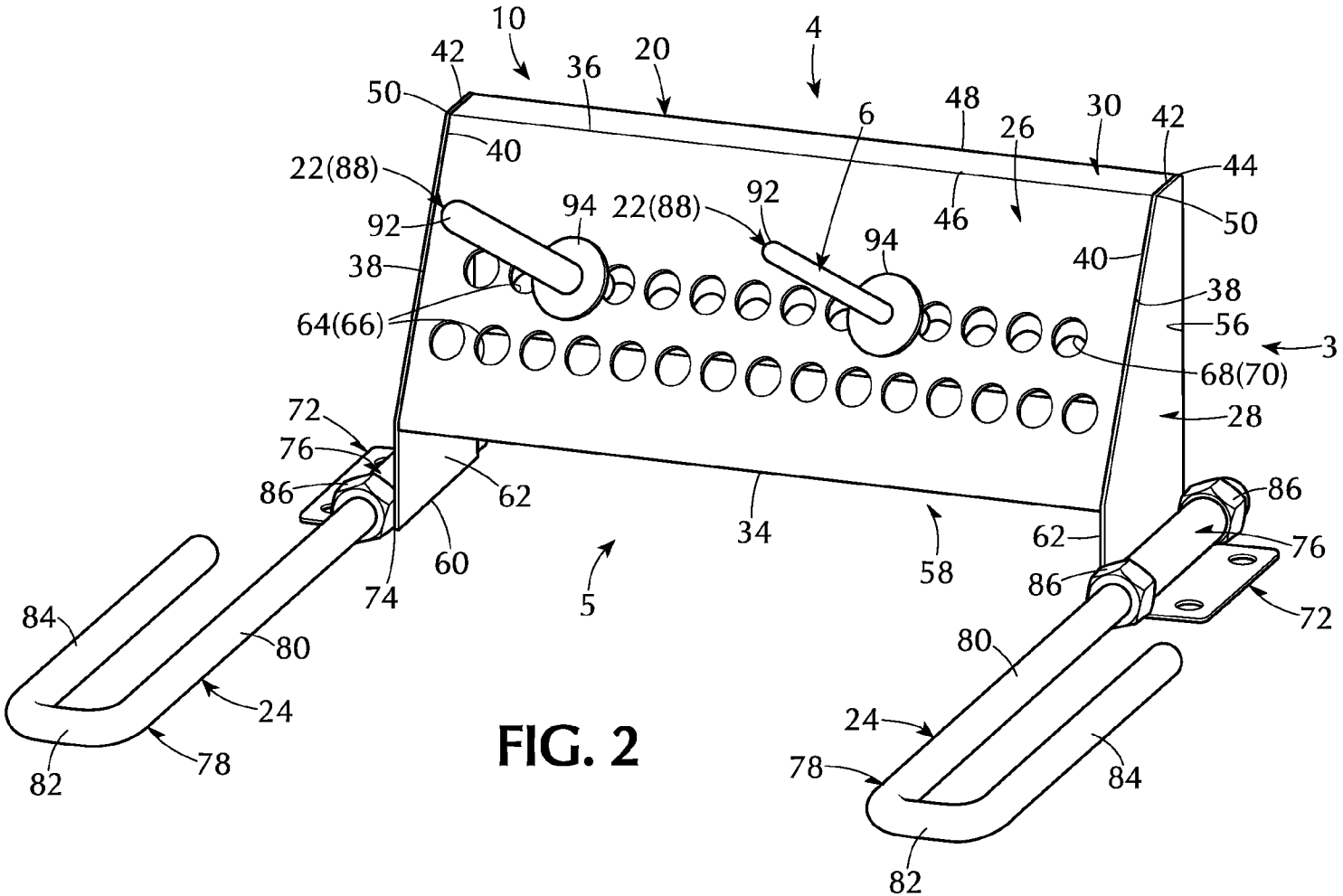
FIG. 2 is an enlarged diagrammatic perspective view of the first embodiment of the customizable storage rack of the present invention identified by ARROW 2 in FIG. 1.
Figure 3:
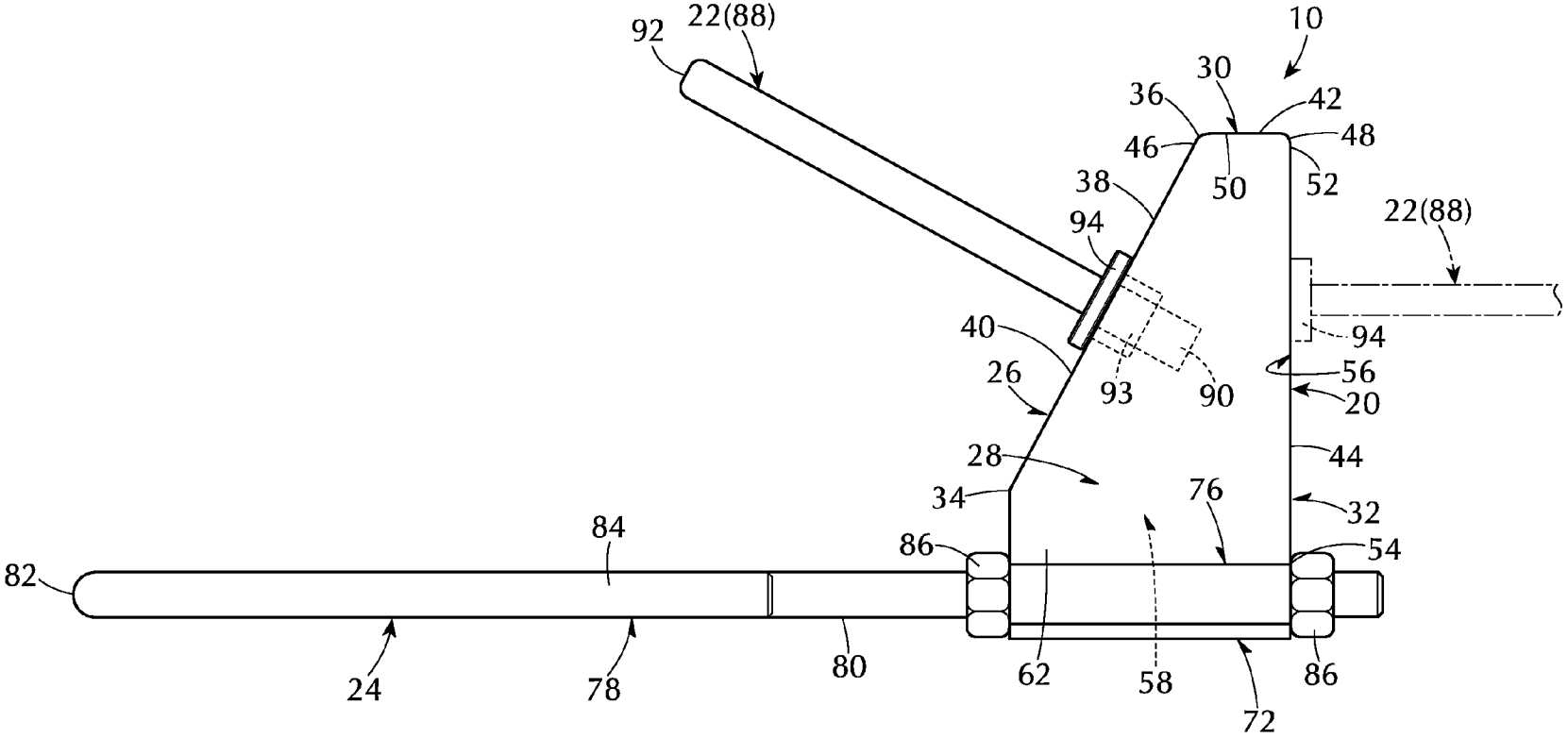
FIG. 3 is an enlarged diagrammatic end view taken generally in the direction of ARROW 3 in FIG. 2.
Figure 4:
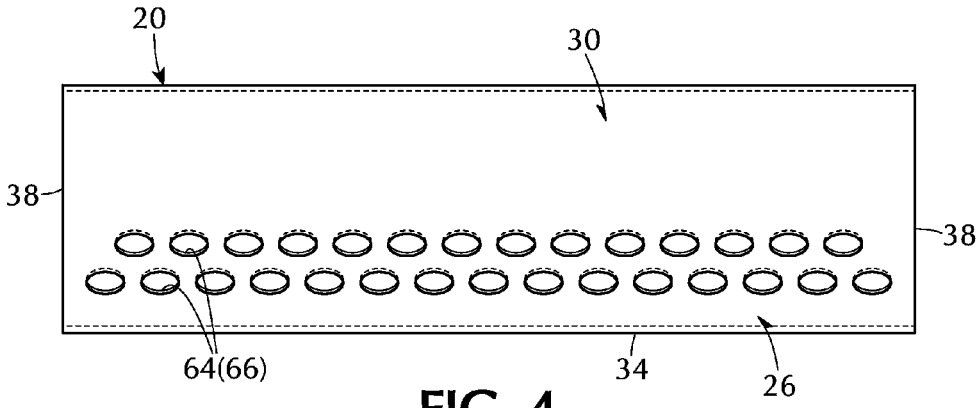
FIG. 4 is a reduced diagrammatic top plan view taken generally in the direction of ARROW 4 in FIG. 2 of the body of the first embodiment of the customizable storage rack of the present invention.
Figure 5:
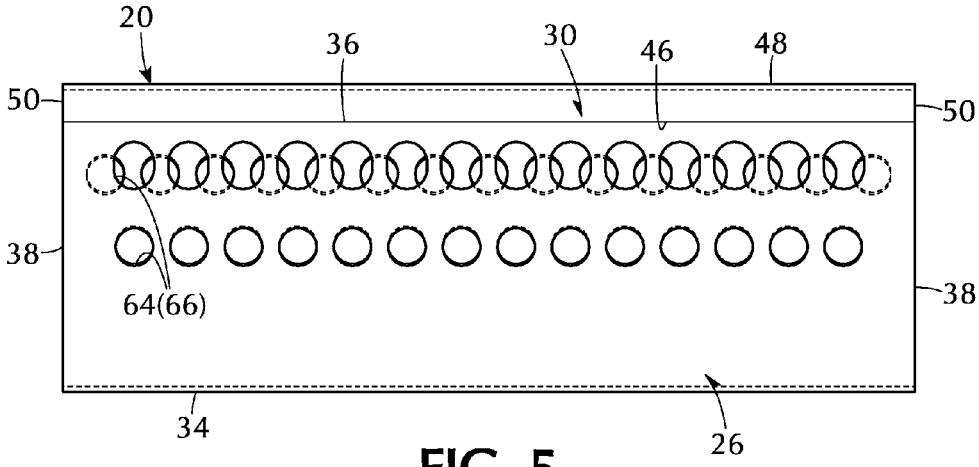
FIG. 5 is a reduced diagrammatic front view taken generally in the direction of ARROW 5 in FIG. 2 of the body of the first embodiment of the customizable storage rack of the present invention.

The specific configuration of the body 20 can best be seen in FIGS. 2, 3, 4, and 5, which are, respectively, again, an enlarged diagrammatic perspective view of the first embodiment of the customizable storage rack of the present invention identified by ARROW 2 in FIG. 1, again, an enlarged diagrammatic end view taken generally in the direction of ARROW 3 in FIG. 2, a reduced diagrammatic top plan view taken generally in the direction of ARROW 4 in FIG. 2 of the body of the first embodiment of the customizable storage rack of the present invention, and a reduced diagrammatic front view taken generally in the direction of ARROW 5 in FIG. 2 of the body of the first embodiment of the customizable storage rack of the present invention, and as such, will be discussed with reference thereto.

The body 20 comprises a front 26, a pair of sides 28, a top 30, and a back 32.

The front 26 of the body 20 has a lower edge 34, an upper edge 36, and a pair of side edges 38, and is rectangularly shaped.

Each side 28 of the body 20 has a forward edge 40, an upper edge 42, and a rear edge 44.

The top 30 of the body 20 has a forward edge 46, a rear edge 48, and a pair of side edges 50, and is rectangularly shaped.

The back 32 of the body 20 has an upper edge 52, a lower edge 54, and a pair of side edges 56, and is rectangularly shaped.

The top 30 of the body 20 extends rearwardly from the front 26 of the body 20, with the forward edge 46 of the top 30 of the body 20 coinciding with the upper edge 36 of the front 26 of the body 20, with the top 30 of the body 20 being horizontally oriented, and with the front 26 of the body 20 being rearwardly slanted from the lower edge 34 of the front 26 of the body 20 to the upper edge 36 of the front 26 of the body 20.

The back 32 of the body 20 extends perpendicularly downwardly from the top 30 of the body 20, with the upper edge 52 of the back 32 of the body 20 coinciding with the rear edge 48 of the top 30 of the body 20, and with the back 32 of the body 20 being vertically oriented.

Each side 28 of the body 20 extends rearwardly from the front 26 of the body 20 to the back 32 of the body 20 and upwardly to the top 30 of the body 20, with the forward edge 40 of each side 28 of the body 20 coinciding with an associated side edge 38 of the front 26 of the body 20, with the upper edge 42 of each side 28 of the body 20 coinciding with an associated side edge 50 of the top 30 of the body 20, and with the rear edge 44 of each side 28 of the body 20 coinciding with an associated side edge 56 of the back 32 of the body 20.

The body 20 further comprises an open bottom 58 and each side 28 of the body 20 further having a bottom edge 60.

Each side 28 of the body 20 further extends downwardly from the open bottom 58 of the body 20 to the bottom edge 60 of an associated side 28 of the body 20 so as to form a pair of side extensions 62.

Each side extension 62 of each side 28 of the body 20 is rectangularly shaped, and is coplanar with an associated side 28 of the body 20.

The front 26 of the body 20 further has a plurality of through bores 64.

The plurality of through bores 64 of the front 26 of the body 20 are so disposed so as to provide parallel rows of through bores 66, and are so sized so as to receive the mandrels 22, respectively.

The back 32 of the body 20 further has a plurality of through bores 68.

The plurality of through bores 68 of the back 32 of the body 20 are so disposed so as to provide parallel rows of through bores 70, and are so sized so as to receive the mandrels 22, respectively.

D. Specific Configuration of the Attaching Apparatus 24

The specific configuration of the attaching apparatus 24 can best be seen in FIGS. 2 and 3, which are, respectively, again, an enlarged diagrammatic perspective view of the first embodiment of the customizable storage rack of the present invention identified by ARROW 2 in FIG. 1, and, again, an enlarged diagrammatic end view taken generally in the direction of ARROW 3 in FIG. 2, and as such, will be discussed with reference thereto.

The attaching apparatus 24 comprises a pair of mounting plates 72.

The pair of mounting plates 72 of the attaching apparatus 24 are rectangularly shaped, are a same length as, and extend perpendicularly outwardly from, the pair of side extensions 62 of the pair of sides 28 of the body 20, respectively, at a pair of junction lines 74, respectively, and are for resting on or being attached to either the top 12 or the bottom 14 of the shelf 16.

The attaching apparatus 24 further comprises a pair of mounting tubes 76.

The pair of mounting tubes 76 of the attaching apparatus 24 extend along the pair of junctions lines 74 of the attaching apparatus 24, respectively, and are of a same length as the pair of mounting plates 72 of the attaching apparatus 24, respectively.

The attaching apparatus 24 further comprises a pair of J-shaped hooks 78. The pair of J-shaped hooks 78 of the attaching apparatus 24 are for hooking over the shelf 16.

Each J-shaped hook 78 of the attaching apparatus 24 has a shank 80, a bend 82, and a point 84.

The shank 80 of each J-shaped hook 78 of the attaching apparatus 24 extends pivotally and collinearly from within an associated mounting tube 76 of the attaching apparatus 24, with the bend 82 of an associated J-shaped hook 78 of the attaching apparatus 24 and the point 84 of the associated J-shaped hook 78 of the attaching apparatus 24 being for hooking over the shelf 16.

The shank 80 of each J-shaped hook 78 of the attaching apparatus 24 is maintained replaceably, pivotally, and collinearly from within an associated mounting tube 76 of the attaching apparatus 24 by a pair of nuts 86.

The pair of nuts 86 of the attaching apparatus 24 straddle an associated mounting tube 76 of the attaching apparatus 24.

E. Specific Configuration of the Mandrels 22

Figure 6:
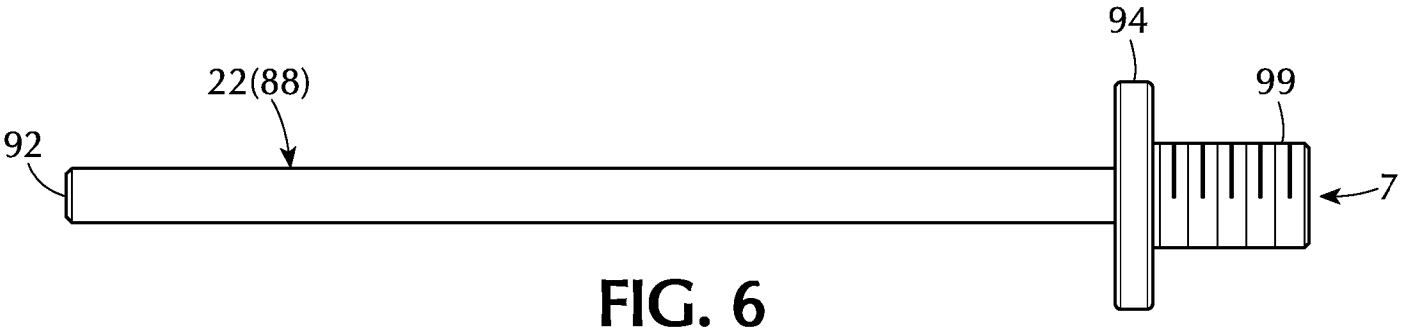
FIG. 6 is a reduced diagrammatic side elevational view of a mandrel of the first embodiment of the customizable storage rack of the present invention identified by ARROW 6 in FIG. 2.
Figure 7:
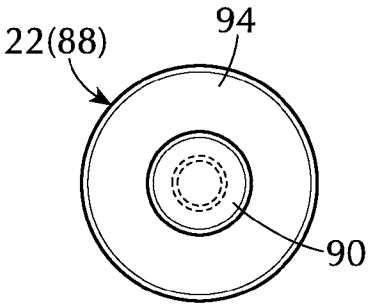
FIG. 7 is an end view taken generally in the direction of ARROW 7 in FIG. 6.

The specific configuration of the mandrels 22 can be best seen in FIGS. 2, 3, 6, and 7, which are, respectively, again, an enlarged diagrammatic perspective view of the first embodiment of the customizable storage rack of the present invention identified by ARROW 2 in FIG. 1, again, an enlarged diagrammatic end view taken generally in the direction of ARROW 3 in FIG. 2, a reduced diagrammatic side elevational view of a mandrel of the first embodiment of the customizable storage rack of the present invention identified by ARROW 6 in FIG. 2, and an end view taken generally in the direction of ARROW 7 in FIG. 6, and as such, will be discussed with reference thereto.

Each mandrel 22 is replaceably secured in any through bore 64 of the front 26 of the body 20 and any through bore 68 of the back 32 of the body 20, extends upwardly therefrom, and is for being received in the barrel 19 of an associated handgun 18.

Each mandrel 22 comprises a peg 88.

The peg 88 of each mandrel 22 is slender, elongated, and cylindrically shaped, and has a proximal end 90 and a distal end 92.

The proximal end 92 of the peg 88 of each mandrel 22 is threaded, and is replaceably secured in any through bore 64 of the front 26 of the body 20 and any through bore 68 of the back 32 of the body 20 by a nut 93 engaging the proximal end 92 of the peg 88 of an associated mandrel 22.

Each mandrel 22 further has a stop ring 94.

The stop ring 94 of each mandrel 22 is collinearly disposed, positioned just forward of the proximal end 90 of the peg 88 of an associated mandrel 22, and provides a stop of how far the proximal end 92 of the peg 88 of the associated mandrel 22 enters any through bore 64 of the front 26 of the body 20 and any through bore 68 of the back 32 of the body 20, with the proximal end 92 of the peg 88 of the associated mandrel then being threadably received by the nut 93 of the associated mandrel 22, and with the distal end 92 of the peg 88 of the associated mandrel 22 for being received by the barrel 19 of an associated handgun 18, while the stop ring 94 of the associated mandrel 22 provides additional protection for the barrel 19 of the handgun 18.

Each mandrel 22 is made from thermoplastic, and the peg 88 of each mandrel 22 has a diameter. The thermoplastic of each mandrel 22 is for preventing any damage to the rifling of the barrel 19 of the handgun 18 when the handgun 18 is being stored on an associated mandrel 22, and is sandable to customize the diameter of the peg 88 of each mandrel 22 to fit an associated handgun 18.

The thermoplastic of each mandrel 22 is polyoxymethylene (POM) whose molecular formula is $(CH_2O)_n$. Polyoxymethylene (POM) is sold under the tradenames DELRIN®, CELCON®, HOSTAFORM®, etc. DELRIN® is a registered trademark of DuPont™.

Polyoxymethylene (POM) is an engineering thermoplastic used in precision parts that require high stiffness, low friction, and excellent dimensional stability.

F. Second Embodiment Introductory

Referring now to FIG. 8, which is a diagrammatic perspective view of a second embodiment of the customizable storage rack of the present invention replaceably mounting either on a top or on a bottom of a shelf, storing handguns, and positioning the handguns at customizable distances from each other, the customizable storage rack of the second embodiment of the present invention is shown generally at 110 for replaceably mounting either on a top 112 or on a bottom 114 of a shelf 116, for storing handguns 118, and for positioning the handguns 118 at customizable distances from each other. Each handgun 118 has a barrel 119 with rifling.

G. Overall Configuration of the Second Embodiment of the Customizable Storage Rack 110

The overall configuration of the customizable storage rack 110 can best be seen in FIG. 9, which is an enlarged diagrammatic perspective view of the second embodiment of the customizable storage rack of the present invention identified by ARROW 9 in FIG. 8, and as such, will be discussed with reference thereto.

The customizable storage rack 110 comprises a body 120, mandrels 122, and attaching apparatus 124. The body 120 is for replaceably mounting either on the top 112 or on the bottom 114 of the shelf 116. The mandrels 122 are replaceably attached to the body 120, are for storing the handguns 118, and are for positioning the handguns 118 at customizable distances from each other. The attaching apparatus 124 replaceably attaches the mandrels 122 to the body 120.

H. Specific Configuration of the Body 120

The body 120 comprises a tube 126.

The tube 126 of the body 120 is straight, vertically oriented, and has a bottom 128.

The body 120 further comprises a mounting disk 130.

The mounting disk 130 of the body 120 is disposed on the bottom 128 of the tube 126 of the body 120, and is for replaceably mounting the body 120 either on the top 112 or on the bottom 114 of the shelf 116.

The mounting disk 130 of the body 120 has through bores 157.

The through bores 157 of the mounting disk 130 of the body 120 are spaced therearound, and are for receiving fasteners for replaceably fastening the body 120 either on the top 112 or on the bottom 114 of the shelf 116.

The tube 126 of the body 120 has a plurality of through bores 158.

The plurality of through bores 158 of the tube 126 of the body 120 are diametrically oriented therethrough, and are spaced-apart axially therealong.

I. Specific Configuration of the Attaching Apparatus 124

The attaching apparatus 124 comprises brackets 172.

Each bracket 172 of the attaching apparatus 124 comprises a collar 174.

The collar 174 of each bracket 172 of the attaching apparatus 124 snugly, replaceably, and movably receives the tube 126 of the body 120, and is replaceably affixed thereto at predetermined elevations therealong.

The collar 174 of each bracket 172 of the attaching apparatus 124 has a through bore 176.

The through bore 176 of the collar 174 of each bracket 172 of the attaching apparatus 124 is diametrically oriented therethrough, and is alignable with any one of the plurality of through bores 158 of the tube 126 of the body 120 so as to allow the collar 174 of each bracket 172 of the attaching apparatus 124 to be replaceably affixed to the tube 126 of the body 120 at predetermined elevations therealong.

Each bracket 172 of the attaching apparatus 124 further comprises a fastener 177.

The fastener 177 of each bracket 172 of the attaching apparatus 124 passes through the through bore 176 of the collar 174 of an associated bracket 172 of the attaching apparatus 124 and through a desired through bore 158 of the tube 126 of the body 120 so as to allow the collar 174 of the associated bracket 172 of the attaching apparatus 124 to be replaceably affixed to the tube 126 of the body 120 at a predetermined elevation therealong.

Each bracket 172 of the attaching apparatus 124 further comprises three wings 178.

Each wing 178 of each bracket 172 of the attaching apparatus 124 is rectangular-shaped, and has an inner boundary 180.

The three wings 178 of each bracket 172 of the attaching apparatus 124 extend radially outwardly from the collar 174 of an associated bracket 172 of the attaching apparatus 124.

The three wings 178 of each bracket 172 of the attaching apparatus 124 are attached to the collar 174 of an associated bracket 172 of the attaching apparatus 124 at the inner boundary of each wing 178 of the associated bracket 172 of the attaching apparatus 124.

The three 178 of each bracket 172 of the attaching apparatus 124 are spaced-apart from each other by angles of 120°.

The three wings 178 of each bracket 172 of the attaching apparatus 124 are tilted in a same direction relative to the collar 174 of an associated bracket 172 of the attaching apparatus 124 at an angle that is greater than 45° but less than 90° so as to mimic the appearance of a propeller.

Each wing 178 of each bracket 172 of the attaching apparatus 124 has a plurality of through bores 182.

J. Specific Configuration of the Mandrels 122

Each mandrel 122 is replaceably secured in any through bore 182 of each wing 178 of each bracket 172 of the attaching apparatus 124, and is for being received in the barrel 119 of an associated handgun 118.

Each mandrel 122 comprises a peg 188.

The peg 188 of each mandrel 122 is slender, elongated, cylindrically shaped, and has a proximal end 190 and a distal end 192.

The proximal end 192 of the peg 188 of each mandrel 122 is threaded, and is replaceably secured in any through bore 182 of each wing 178 of each bracket 172 of the attaching apparatus 124 by a nut 193 engaging the proximal end 192 of the peg 188 of an associated mandrel 122.

Each mandrel 122 further has a stop ring 194.

The stop ring 194 of each mandrel 122 is collinearly disposed, positioned just forward of the proximal end 190 of the peg 188 of an associated mandrel 122, and provides a stop of how far the proximal end 192 of the peg 188 of the associated mandrel 122 enters any through bore 182 of each wing 178 of each bracket 172 of the attaching apparatus 124, with the proximal end 192 of the peg 188 of the associated mandrel 122 then being threadably received by the nut 193 of the associated mandrel 122, and with the distal end 192 of the peg 188 of the associated mandrel 122 for being received by the barrel 119 of an associated handgun 118, while the stop ring 194 of the associated mandrel 122 provides additional protection for the barrel 119 of the handgun 118.

Each mandrel 122 is made from thermoplastic, and the peg 188 of each mandrel 122 has a diameter. The thermoplastic of each mandrel 122 is for preventing any damage to the rifling of the barrel 119 of the handgun 118 when the handgun 118 is being stored on an associated mandrel 122, and is sandable to customize the diameter of the peg 188 of each mandrel 122 to fit an associated handgun 118.

The thermoplastic of each mandrel 122 is polyoxymethylene (POM) whose molecular formula is $(CH_2O)_n$. Polyoxymethylene (POM) is sold under the tradenames DELRIN®, CELCON®, HOSTAFORM®, etc. DELRIN® is a registered trademark of DuPont™.

Polyoxymethylene (POM) is an engineering thermoplastic used in precision parts that require high stiffness, low friction, and excellent dimensional stability.

K. Impressions

It will be understood that each of the elements described above or two or more together may also find a useful application in other types of constructions differing from the types described above.

While the embodiments of the present invention have been illustrated and described as embodied in a customizable storage rack for replaceably mounting either on a top or on a bottom of a shelf, for storing handguns, and for positioning the handguns at customizable distances from each other, nevertheless, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A customizable storage rack replaceably mounted either on a top or on a bottom of a shelf, stores handguns, and positions the handguns at customizable distances from each other, wherein the handgun has a barrel with rifling, and wherein said customizable storage rack comprising:

a) a body, wherein the body comprises a front, a pair of sides, a top, and a back;

b) mandrels; and c) an attaching apparatus, wherein said attaching apparatus includes a pair of mounting plates that extend perpendicularly outward from the sides of the body, wherein the mounting plates each include openings configured to receive fasteners, wherein a mounting tube abuts a portion of each respective mounting plate in order to wedge the respective mounting plates between the shelf and the mounting tubes, and wherein the attaching apparatus further includes a pair of J-shaped hooks each have a shank, a bend, and a distal end portion; wherein the corresponding shanks are each replaceably inserted within the corresponding mounting tubes allowing the shanks to pivot and adjust telescopically from within the mounting tubes; wherein the corresponding shanks are maintained within the corresponding mounting tubes by a pair of nuts;

wherein said mandrels are replaceably attached to said body;

wherein said mandrels store the handguns;

wherein said mandrels position the handguns at customizable distances from each other; wherein, when in use, the J-shaped hooks are used to clamp the body to either the top or bottom of the shelf.

2. The customizable storage rack of claim 1 wherein said front of said body has:

a) a lower edge;

b) an upper edge; and c) a pair of side edges; and wherein said front of said body is rectangularly shaped.

3. The customizable storage rack of claim 2, wherein each side of said body has:

a) a forward edge;

b) an upper edge; and c) a rear edge.

4. The customizable storage rack of claim 3, wherein said top of said body has:

a) a forward edge;

b) a rear edge; and c) a pair of side edges; and wherein said top of said body is rectangularly shaped.

5. The customizable storage rack of claim 4, wherein said back of said body has:

a) an upper edge;

b) a lower edge; and c) a pair of side edges; and wherein said back of said body is rectangularly shaped.

6. The customizable storage rack of claim 1, wherein said top of said body extends rearwardly from said front of said body; and wherein said top of said body is horizontally oriented.

7. The customizable storage rack of claim 4, wherein said forward edge of said top of said body coincides with said upper edge of said front of said body.

8. The customizable storage rack of claim 2, wherein said front of said body is rearwardly slanted from said lower edge of said front of said body to said upper edge of said front of said body.

9. The customizable storage rack of claim 1, wherein said back of said body extends perpendicularly downwardly from said top of said body; and wherein said back of said body is vertically oriented.

10. The customizable storage rack of claim 5, wherein said upper edge of said back of said body coincides with said rear edge of said top of said body.

11. The customizable storage rack of claim 1, wherein each side of said body extends rearwardly from said front of said body to said back of said body; and wherein each side of said body extends upwardly to said top of said body.

12. The customizable storage rack of claim 3, wherein said forward edge of each side of said body coincides with an associated side edge of said front of said body.

13. The customizable storage rack of claim 4, wherein said upper edge of each side of said body coincides with an associated side edge of said top of said body.

14. The customizable storage rack of claim 5, wherein said rear edge of each side of said body coincides with an associated side edge of said back of said body.

15. The customizable storage rack of claim 1, wherein said body comprises an open bottom;

wherein each side of said body has a bottom edge; and wherein each side of said body extends downwardly from said open bottom of said body to said bottom edge of an associated side of said body so as to form a pair of side extensions.

16. The customizable storage rack of claim 15, wherein each side extension of each side of said body is rectangularly shaped; and wherein each side extension of each side of said body is coplanar with an associated side of said body.

17. The customizable storage rack of claim 1, wherein said front of said body has a plurality of through bores.

18. The customizable storage rack of claim, 17, wherein said plurality of through bores of said front of said body are so disposed so as to provide parallel rows of through bores; and wherein said plurality of through bores of said front of said body are so sized so as to receive said mandrels, respectively.

19. The customizable storage rack of claim 17, wherein said back of said body has a plurality of through bores.

20. The customizable storage rack of claim 19, wherein said plurality of through bores of said back of said body are so disposed so as to provide parallel rows of through bores; and wherein said plurality of through bores of said back of said body are so sized so as to receive said mandrels, respectively.

21. The customizable storage rack of claim 1, wherein said pair of mounting plates of said attaching apparatus are rectangularly shaped;

wherein said pair of mounting plates of said attaching apparatus are a same length as said pair of side extensions of said pair of sides of said body, respectively;

wherein said pair of mounting plates of said attaching apparatus extend perpendicularly outwardly from said pair of side extensions of said pair of sides of said body, respectively, at a pair of junction lines, respectively; and wherein said pair of mounting plates of said attaching apparatus are for resting on or being attached to either the top or the bottom of the shelf.

22. The customizable storage rack of claim 1, wherein said pair of mounting tubes of said attaching apparatus extend along said pair of junctions lines of said attaching apparatus, respectively; and wherein said pair of mounting tubes of said attaching apparatus are of a same length as said pair of mounting plates of said attaching apparatus, respectively.

23. The customizable storage rack of claim 1, wherein said pair of nuts of said attaching apparatus straddle an associated mounting tube of said attaching apparatus.

24. The customizable storage rack of claim 19, wherein each mandrel is replaceably secured in any through bore of said front of said body and any through bore of said back of said body;

wherein each mandrel extends upwardly; and wherein each mandrel is for being received in the barrel of an associated handgun.

25. The customizable storage rack of claim 19, wherein each mandrel comprises a peg.

26. The customizable storage rack of claim 25, wherein said peg of each mandrel is slender;

wherein said peg of each mandrel is elongated;

wherein said peg of each mandrel is cylindrically shaped; and wherein said peg of each mandrel has:

a) a proximal end; and b) a distal end.

27. The customizable storage rack of claim 26, wherein said proximal end of said peg of each mandrel is threaded; and wherein said proximal end of said peg of each mandrel is replaceably secured in any through bore of said front of said body and any through bore of said back of said body by a nut.

28. The customizable storage rack of claim 26, wherein each mandrel has a stop ring.

29. The customizable storage rack of claim 28, wherein said stop ring of each mandrel is collinearly disposed;

wherein said stop ring of each mandrel is positioned just forward of said proximal end of said peg of an associated mandrel;

wherein said stop ring of each mandrel provides a stop of how far said proximal end of said peg of said associated mandrel enters any through bore of said front of said body and any through bore of said back of said body, and then said proximal end of said peg of said associated mandrel threadably receives said nut of said associated mandrel; and wherein said distal end of said peg of each mandrel is for receiving the barrel of an associated handgun, while said stop ring of each mandrel provides additional protection for the barrel of the handgun.

30. The customizable storage rack of claim 25, wherein said peg of each mandrel, is made from thermoplastic;

wherein said thermoplastic of said peg of each mandrel is for preventing any damage to the rifling of the barrel of the handgun when the handgun is being stored on said peg of an associated mandrel;

wherein said peg of each mandrel has a diameter; and wherein said thermoplastic of said peg of each mandrel is sandable to customize said diameter of said peg of an associated mandrel to fit an associated handgun.

31. The customizable storage rack of claim 30, wherein said thermoplastic of said peg of each mandrel is polyoxymethylene (POM); and wherein said polyoxymethylene (POM) of said thermoplastic of said peg of each mandrel has a molecular formula of $(CH_2O)_n$.

* * * * *